United States Patent [19]

Baach

[11] Patent Number: 4,710,644

[45] Date of Patent: Dec. 1, 1987

[54] REPLACEABLE DEEP ANODE SYSTEM

[75] Inventor: Michael K. Baach, Houston, Tex.

[73] Assignee: Corrpro Companies, Inc., Medina, Ohio

[21] Appl. No.: 792,963

[22] Filed: Oct. 30, 1985

[51] Int. Cl.[4] ..... C23F 13/02

[52] U.S. Cl. ..... 307/95; 204/147; 204/196

[58] Field of Search ..... 307/95; 174/6; 204/147, 204/196, 148, 197, 284, 286, 290 F

[56] References Cited

U.S. PATENT DOCUMENTS

| | | | |
|---|---|---|---|
| 3,134,731 | 5/1964 | Heuze | 204/196 |
| 3,725,669 | 4/1973 | Tatum | 174/6 X |
| 4,170,532 | 10/1979 | Tatum | 204/147 X |
| 4,400,259 | 8/1983 | Schutt | 204/147 X |
| 4,526,667 | 7/1985 | Parkhurst et al. | 204/147 X |

OTHER PUBLICATIONS

MATCOR Advertisement for a replaceable deep anode system.

*Primary Examiner*—William M. Shoop, Jr.
*Assistant Examiner*—Bentsu Ro
*Attorney, Agent, or Firm*—Fay, Sharpe, Beall, Fagan, Minnich & McKee

[57] ABSTRACT

A replaceable deep anode system for the cathodic protection of underground metallic structures is disclosed. The system includes an anode casing received in a drilled hole. The casing has an electrically non-conductive upper portion and a substantially incorrodible electrically conductive lower portion preferably comprising a steel piping having a coating of a conductive polymer. A selectively insertable anode is received in the casing contiguous to the lower portion to define an active anode area. Electrically conductive material received in the casing adjacent the anode and about the casing lower portion provides a primarily electronic current path from the anode to the drilled hole wall. The casing provides an integral anode housing for selective removal and resupply of anodes as may be needed over a period of time. The conductive polymer preferably comprises a polymer concrete including conductive carbon elements.

11 Claims, 6 Drawing Figures

FIG. 1
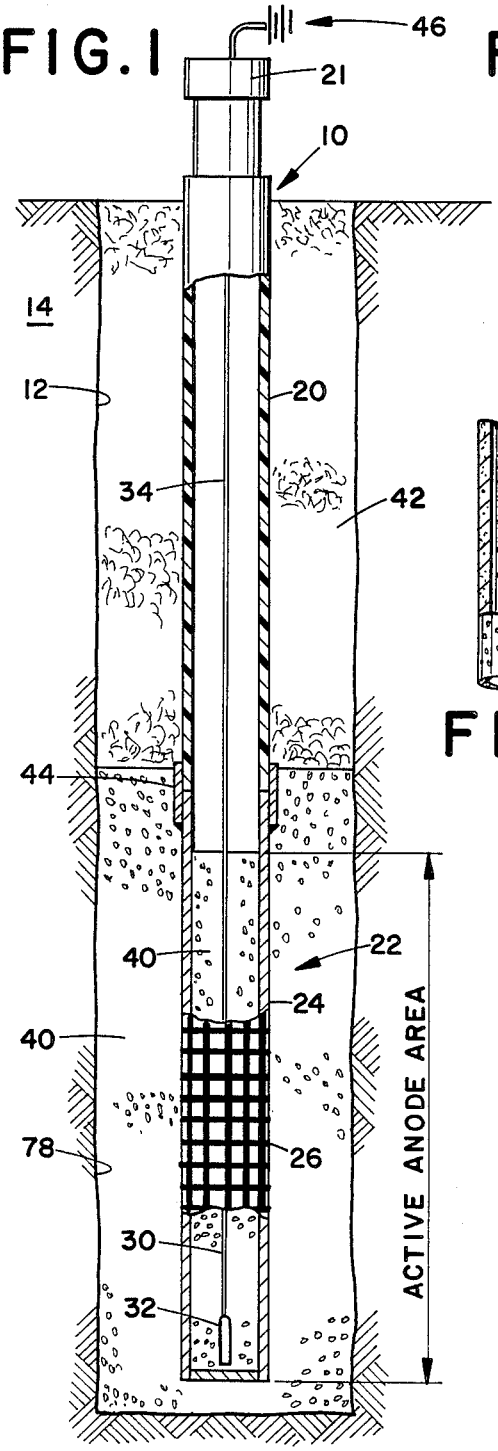
FIG. 2
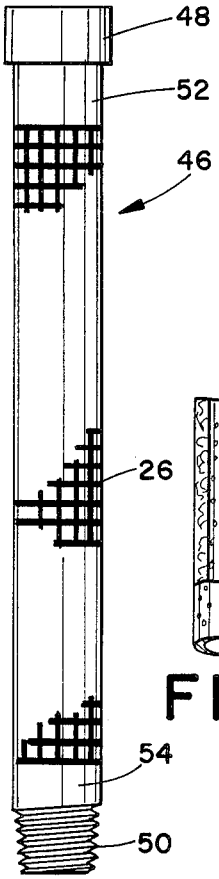
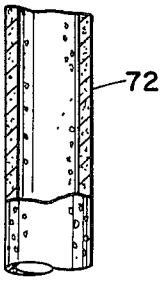
FIG. 5
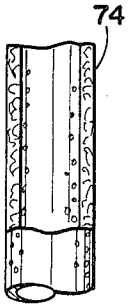
FIG. 6
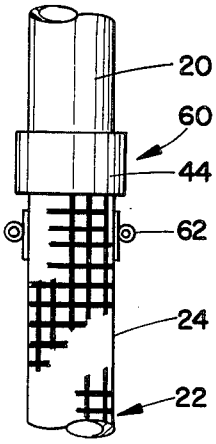
FIG. 3
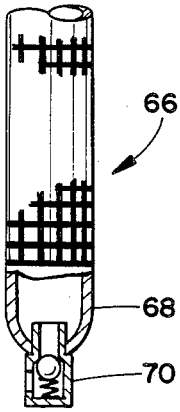
FIG. 4

REPLACEABLE DEEP ANODE SYSTEM

BACKGROUND OF THE INVENTION

This invention pertains to the art of cathodic protection methods and systems and, more particularly, to a deep well anode system for preventing corrosion of underground metallic structures by impressing electric currents thereon to make such structures cathodic with respect to the surrounding soil which functions as an electrolyte.

The invention is particularly applicable to a replaceable deep anode system received in a drilled hole and having a conductive polymer casing in an active anode area which provides improved electronic connection between the anode and the surrounding soil and which assures that the integrity of the drilled hole can be maintained during anode replacement. However, it will be appreciated to those skilled in the art that the invention can be readily adapted for use in other environments as, for example, where similar casing devices are employed to protect or house electrodes in other types of harsh environments.

The use of deep well ground beds or anode systems to introduce cathodic protection currents into the soil from an external electrical energy source to equalize or overcome the natural corrosion process of an underground or submerged metal structure is known in the art. Typically, such deep well ground beds comprise a drilled hole extending from the surface to a depth of in excess of fifty feet. Anodes are placed in the hole and impressed with electrical energy to generate the cathodic protection desired in the surrounding soil. However, variable geology of the surrounding soil makes such a construction substantially unreliable over along term and particularly expensive to replace as often the entire depth of the hole has to be redrilled. The failure of the anode connection or anode cable, in combination with irregular anode depletion has caused premature failures of these systems and generally unacceptable system life. Other problems with such systems have resulted from relatively poor electronic connection between the anode and the surrounding soil. Where current would flow through ambient fluids, such as water, gas bubbles have been generated which when accumulated form an insulating gas formation pocket which has contributed to system failure.

In order to overcome the cost ramifications of reinstalling a deep anode bed and drilling a new hole, and to overcome the problems of systems having a relatively unreliable system life, the industry has long sought a replaceable deep anode system in which the anodes could be selectively replaced and in which the integrity of the drilled hole could be maintained indefinitely. One attempt at such a replaceable deep anode is disclosed in U.S. Pat. No. 3,725,669 to Tatum. This patent discloses a replaceable anode casing received in a drilled hole having a continuous casing upper portion constructed of a non-conductive chemically inert material such as plastic and a lower portion constructed of a like material but including a plurality of openings to provide for the conduction of electrical current from an anode contained in the casing lower portion through ambient granular conductive material and ultimately out through the surrounding soil. However, such a system has suffered from a number of inherent problems. Specifically, the use of a non-conductive casing including a plurality of holes through which current can be transmitted provides a relatively large diameter casing with a restricted current path. The large diameter is required to accommodate the plurality of holes and retain the integral strength to house the granular material and maintain the integrity of the drilled hole during anode replacement. Related to the size problem is the economic consequence of such a construction in that the drilled hole, due to its large diameter, is relatively more expensive to make and the cost of materials for the casing and the granular fill is accordingly also greater.

The present invention contemplates a new and improved replaceable deep anode system which overcomes all of the financial and technological problems of conventional and replaceable deep anode systems to provide a new system which is simple in design, more economical to manufacture and install, readily adaptable to a plurality of dimensional characteristics, provides improved ease in anode replacement and improved cathodic protection in a replaceable deep anode system.

BRIEF SUMMARY OF THE INVENTION

In accordance with the present invention, there is provided a replaceable deep anode system for the cathodic protection of underground metallic structures. The system includes a rigid casing received within a drilled hole. The casing has a top portion of non-conductive material and a lower portion of substantially incorrodible, dimensionally stable, electrically conductive material. An anode is received within the lower portion of the casing to generally define a system active anode area. Electrically conductive material is received in the casing contiguous to the anode and is further disposed about an outer wall surface of the casing lower portion to provide an electrically conductive path from the anode, through the conductive material received within the casing, through the casing lower portion and outer ambient conductive material, and ultimately to the wall of the drilled hole of the surrounding soil. Means are provided for selectively positioning the anode in the lower portion for selective removal and replacement of the anode. A means is provided for supplying electrical energy to the anode whereby upon corrosion of the anode, the anode may be selectively retrieved and replaced in the casing while maintaining the integrity of the drilled hole.

In accordance with another aspect of the present invention, the casing lower portion comprises a substantially rigid, electrically conductive piping wall including an electrically conductive polymer coating. The coating provides an electronic connection to the wall for substantial electronic current communication through the casing. The coating is disposed on the casing outer peripheral wall surface.

In accordance with a more limited aspect of the present invention, the polymer coating is disposed in a spaced pattern on the casing lower portion. The spacing may comprise a cross-hatching or a plurality of longitudinal and sinusoidal polymer lines.

In accordance with another aspect of the present invention, the lower portion of the casing comprises a continuous piping of conductive polymer concrete. Alternatively, for added strength, the polymer concrete may contain mesh, fibers, or strands of conductive or non-conductive matter.

One benefit obtained by the use of the present invention is a replaceable deep anode system including a relatively small diameter casing package with improved electrical conductivity between the anode and the surrounding soil. The relatively small diameter casing package provides cost savings in drilling, material and installation costs.

Another benefit of the present invention is the improved electronic conductivity between the conductive material contiguous to the anode, the conductive casing itself, and the conductive material ambient to the casing for improved current discharge from the anode to the conductive material with little, if any, metal loss. The result is a system with an even longer system life than previous conventional or replacement systems.

Yet another benefit of the present invention is a replaceable deep anode system in which the anodes are easier and less costly to replace than prior known systems. The compact dimensions of the system require less displacement of electrically conductive material volumes during the replacement operation. The use of small diameter anodes further contributes to the savings in material, transport and installation costs.

Other benefits and advantages for the subject new replaceable deep anode system will become apparent to those skilled in the art upon a reading and understanding of this specification.

BRIEF DESCRIPTION OF THE DRAWINGS

The invention may take physical form in certain parts and arrangements of parts, the preferred and alternative embodiments of which will be described in detail in this specification and illustrated in the accompanying drawings which form a part hereof and wherein:

FIG. 1 is a vertical cross sectional view in out-of-scale proportions illustrating a replaceable deep anode system formed in accordance with the present invention installed in a subterranean location;

FIG. 2 is a fragmentary section of the lower portion of the structure of FIG. 1 illustrating a typical joint casing member in the active anode area of the anode assembly;

FIG. 3 is a fragmentary section of the top joint member of the active anode area of an anode assembly formed according to the present invention;

FIG. 4 is a fragmentary section of a bottom most joint member of the active anode area;

FIG. 5 is a fragmentary view in partial cross section of an alternative embodiment of a joint casing member in the active anode area; and, FIG. 6 is a fragmentary view in partial cross section of yet another alternative embodiment of a joint member in an active anode area of an anode assembly formed in accordance with the present invention.

DETAILED DESCRIPTION OF THE INVENTION

Referring now to the drawings wherein the showings are for purposes of illustrating preferred and alternative embodiments of the invention only and not for purposes of limiting same, the FIGURES show a replaceable deep anode assembly 10 received in a drilled hole 12 in a soil environment 14 useful for providing cathodic protection to a wide variety of underground structures such as a pipeline.

With reference to FIG. 1, the drilled hole typically will extend in excess of fifty feet and require joining a number of pipe sections as will hereinafter be more fully explained. Since it is a feature of the invention that a relatively small diameter anode casing package is employed, the drilled hole is typically only a five or six inch diameter hole as opposed to other replaceable anode systems which employ a larger diameter hole and casing. Such a relatively small diameter hole reduces the drilling cost and installation and also decreases the total requirements of backfill used in the hole.

The anode assembly 10 is comprised of an elongated anode casing having a first electrically non-conductive upper portion 20 and a second electrically conductive lower portion 22. The second portion preferably comprises a generally cylindrical piping including an electrically conductive wall 24 and an electrically conductive polymer coating 26. The coated wall generally defines a system active anode area for the anode assembly 10. The wall 24 is preferably two or three inch diameter steel pipe to allow the flow of current through the anode casing lower portion 22. The polymer coating 26 preferably comprises conductive polymer concrete, such as is supplied by the Hydrozo Coatings Company of Lincoln, Nebr. under the trademark CP 1200. The polymer coating 26 is disposed on the outer peripheral wall surface of the piping 24 in a spaced pattern which is particularly illustrated as a cross hatched pattern. Alternatively, the coating can be placed in a number of different patterns such as elongated longitudinal lines interspersed with sinusoidal curving coating lines.

The spacing of the polymer coating 26 on the piping 24 is desirous where it is possible that at some future time, the polymer coating may become non-conductive, in which case the piping 24 will still provide a conductive path where it is uncoated but may corrode due to normal subterranean electrolitic corrosion activity. Conductive polymer concrete is substantially chemically inert but contains electrically conductive carbon elements which may, over a long period of time, lose their conductivity or pass out of the concrete. Regardless of any change in its conductivity though, the polymer coating 26 will remain dimensionally stable to define a housing lower portion 22 insuring a casing for the containment of an anode and to maintain the integrity of the drilled hole 12 during anode replacement. By dimensionally stable is meant that even though conductive elements in the polymer coating 26 may be lost or become non-conductive over time, the polymer maintains its rigid form and remains otherwise uneffected by natural subterranean corrosive elements and reactions.

A small diameter anode 30 is positioned in the lower portion 22. An anode lowering weight 32 provides a weighted biasing of the anode and aids in positioning the anode in the lower portion 22. Anode leadwire 34 extends into the casing from the casing top portion uppermost terminal end adjacent casing cap 21 and selectively positions and suspends the anode in the lower portion active anode area. The anode leadwire 34 also provides a means for withdrawing the anode 30 from the lower portion when the anode needs to be replaced.

An electrically conductive medium 40 such as a conductive electrolyte or a conductive granular material, preferably comprising calcined petroleum coke, is disposed within and about the casing lower portion 22 at the active anode area to provide an electrically conductive path from the anode 30 through the casing lower portion steel wall 24 through the conductive polymer 26 and ultimately to the drilled hole 12.

The casing upper portion 20 is preferably a two or three inch diameter electrically non-conductive pipe comprising either coated steel piping or plastic piping.

Granular material 42, such as gravel, sand or cuttings, is disposed about the top portion of the casing 20. A conventional coupling 44 joins the top portion 20 to the lower portion 22. A dielectric insulating material is preferably included at the joint 44 for insulating the casing upper portion from the casing lower portion. A conventional source of supply of electrical energy 46 supplies electrical energy to the anode 30 through the anode leadwire 34.

With particular attention to FIG. 2, a typical joint member 46 in the casing active anode area is illustrated. Typically, member 46 comprises a ten foot section of two or three inch diameter steel piping. It is within the scope of the invention that a plurality of such joint members 46 can be joined to form the lower portion 22 of the casing to provide an integral anode housing for the anodes contained in the active anode area. Each joint member 46 includes a conventional coupling 48 for threaded connection to an adjacent joint member terminal end threaded section 50. Portions 52, 54 of the joint member 46 immediately adjacent the coupling 48 and threaded end 50 are not coated with conductive polymer at the time of the coating of the remaining portions of the member 46. This is because the joint coupling is to be field coated with a dielectric material after assembly. The conductive polymer 26 applied to the remaining portions of each joint member 46 is applied to cover at least 50% of the piping surface and can cover up to 100% of the surface of the piping wall 24. The polymer coating can have any thickness but preferably a thickness of approximately one-eighth of an inch on up is applied. The pattern and extent of polymer coating can be adjusted to the need of the particular anode assembly.

With particular attention to FIG. 3, the top joint section 60 of the active anode area is particularly illustrated. The upper portion of the casing 20 comprises a two or three inch diameter non-conductive piping extending from the coupling 44 to the surface. Coupling 44 comprises a two or three inch diameter steel to two or three inch diameter plastic transition fitting including a dielectric insulating material to insulate the steel piping 24 of the lower portion of the casing 22 from the upper portion 20. Steel eye-ring lowering assemblies 62 are fastened to the piping 24 with a conventional fastening means such as a weld and assist in lowering the piping into the drilled hole 12.

With particular attention to FIG. 4, a bottom most joint section 66 of the lower portion of the casing is illustrated. Section 66 includes a steel end cap 68 and a ball check valve 70 useful for flushing fluids to the outside of the casing by pressurizing and opening the check valve 70.

With particular attention to FIG. 5, an alternative embodiment of the lower portion of the casing is illustrated. It is within the scope of the invention to include a casing active anode area comprised of a piping constructed of entirely conductive polymer. The conductive polymer piping 72 would be employed in the anode assembly in place of the steel piping coated with the conductive polymer as illustrated in FIGS. 1–4. Alternatively, the polymer piping 72 could be strengthened as shown in the piping 74 of FIG. 6 by including in the piping 74 reinforcing members such as reinforcing mesh or fiber strands. Such reinforcing members can be either electrically conductive or electrically non-conductive.

OPERATION

With particular attention to FIG. 1, the improved operating characteristics of the new replaceable deep anode assembly will be discussed.

It is an overall purpose of the active anode assembly to provide a primarily electronic current flow from an anode 30 through a conductive casing 22 and through the outer coke column and insure that the integrity of the drilled hole 12 will be maintained indefinitely. The non-conductive casing upper portion 20 provides access to the active anode area while restricting the positive current discharge from the anode to the desired deeper strata. The non-conductive casing 20 is typically terminated above grade with a vented cap 21 to allow for the egress of gas or air bubbles which may form within the casing. It should be noted that the casing upper portion 20 contains no coke backfill to allow for the ready expiration of any gas that may be formed adjacent the anode 30 in the lower casing portion 22.

Another purpose of the casing is to prevent the intrusion of the drilled hole fluids during installation. The casing package prevents contact with the anode of any contaminants which could be contained in such fluids and that could hamper anode performance.

Once the casing is in place in the drilled hole 12, a dimensionally stable anode 30 is installed inside the casing lower portion 22 extending the full length of the lower portion active anode area. Preferably, a dimensionally stable anode is employed having a low consumption rate, an ability to withstand low pH environments, an easy connection quality and high electrical conductivity. Coke backfill 40 is then installed around the anode 30. The coke provides a contaminant-free carbon environment surrounding the anode such that when the anode is energized, current transfer from the anode to the coke will be almost entirely electronic. Such current transfer will further prolong the life of the system. Coke backfill 40 is also installed in the active anode area in the drilled hole annulus about the lower portion active anode area. Such backfill also provides for primarily electronic current transfer from the electrically conductive polymer coating 26 through the outer coke. Accordingly, the majority of the electrolitic discharge and, in turn, any metal loss will occur at the drilled hole/outer coke junction 78.

Should the system 10 fail for any reason, the anode 30 and coke backfill 40 on the inside of the casing lower portion 22 can be quickly, easily, and economically removed and replaced. Because the non-conductive upper casing portion 20 acts as a conduit to the interior coke column 40 in the active anode area, the coke 40 can be flushed into suspension through the use of a small diameter hose and pump assembly (not shown). Once this is accomplished, the anode 30 can be removed and replaced, coke 40 reinstalled and the system re-energized all in one simple procedure.

Because the conductive polymer of the casing lower portion 22 is substantially incorrodible, a dimensionally stable housing for the anode 30 will be maintained indefinitely to allow for selective removal and resupply of the anode 30. Even in such instances where the steel piping of the lower portion 22 is corroded, and the polymer coating 26 could become non-conductive, a primarily electronic transfer between the anode and the drilled hole 12 is maintained by current transfer from the coke contained within the polymer coating mesh 26 and the coke on the exterior of the coating 26 since such coke will tend to engage and merge in those portions where the steel is corroded away.

The invention has been described with reference to the preferred embodiment. Obviously, modifications and alterations will occur to others upon the reading and understanding of the specification. It is my intention to include all such modifications and alterations insofar as they come within the scope of the appended claims or the equivalents thereof.

Having thus described my invention, I now claim:

1. An anode assembly for cathodic protection of subterranean structures comprising in combination:

an elongated anode casing having a first upper electrically non-conductive portion and a second lower electrically conductive portion, said second portion comprising an electrically conductive wall including an electrically conductive polymer coating;

an anode received in said casing;

electrically conductive material received in said casing contiguous to said anode and further disposed about an outer wall surface of said casing second portion; and, means for supplying electrical energy to said anode whereby electrical energy flows from said anode through said electrically conductive materials and through said polymer coating to cause the subterranean structures to become cathodic and thereby substantially prevent corrosion of such structures.

2. The anode assembly as defined in claim 1 wherein said polymer coating is disposed on an outer peripheral wall surface of said electrically conductive wall.

3. The anode assembly as defined in claim 1 wherein said polymer coating is disposed in a spaced pattern at said electrically conductive wall.

4. The anode assembly as defined in claim 1 wherein said polymer coating entirely encases said electrically conductive wall.

5. A replaceable deep anode system for the cathodic protection of underground metallic structure comprising:

a rigid casing received within a drilled hole, said casing having a top portion of non-conductive material and a lower portion of substantially chemically inert conductive material, generally defining a system active anode area;

an anode received within said lower portion;

means for selectively positioning said anode in said lower portion;

electrically conductive material received within and about said casing at said active anode area to provide an electrically conductive path from said anode through said casing lower portion and to the drilled hole; and, means for supplying electrical energy to the anode whereby upon sacrificial corrosion of the anode, the anode may be selectively retrieved and replaced in said casing while maintaining the integrity of the drilled hole indefinitely.

6. The anode system as claimed in claim 5 wherein said means for selectively positioning comprises an anode lead wire extending into said casing from an uppermost terminal end of said casing top portion, secured to said anode for selective lowering and raising of the anode from the casing, and an anode lowering weight secured to the anode for weighted biasing of the anode in the casing.

7. The anode system as claimed in claim 5 wherein said lower portion comprises a tubing of conductive polymer concrete.

8. The anode system as claimed in claim 7 wherein said tubing includes reinforcing members.

9. The anode system as claimed in claim 5 wherein granular electrically non-conductive material is disposed in the drilled hole about the casing top portion.

10. A replaceable anode system for the cathodic protection of underground metallic structures comprising:

an anode casing having an electrically non-conductive, dimensionally stable portion and a substantially incorrodible, dimensionally stable, electrically conductive portion, a selectively insertable anode received in the casing contiguous to the conductive portion, and electrically conductive material received in said casing adjacent the anode and about the casing conductive portion whereby said casing provides an integral anode housing for selective removal and resupply of anodes.

11. The anode system as claimed in claim 10 wherein a dielectric insulating material is included at a joint between said non-conductive portion and said conductive portion.

* * * * *